US009561508B2

(12) United States Patent
Niklewski et al.

(10) Patent No.: US 9,561,508 B2
(45) Date of Patent: Feb. 7, 2017

(54) ROLLER FOR HIGH PRESSURE ROLLER GRINDER, ROLLER GRINDER, AND METHOD FOR ASSEMBLING A ROLLER FOR A ROLLER GRINDER

(75) Inventors: Andrzej Niklewski, Alto de Pinheiros (BR); Paulo Barscevicius, Sorocaba (BR)

(73) Assignee: Metso Brasil Industria E Comercio LTDA, Sao Paulo (BR)

( * ) Notice: Subject to any disclaimer, the term of this patent is extended or adjusted under 35 U.S.C. 154(b) by 767 days.

(21) Appl. No.: 13/806,156

(22) PCT Filed: Jun. 14, 2011

(86) PCT No.: PCT/IB2011/052568

§ 371 (c)(1),
(2), (4) Date: Feb. 21, 2013

(87) PCT Pub. No.: WO2011/161583

PCT Pub. Date: Dec. 29, 2011

(65) Prior Publication Data

US 2014/0145018 A1 May 29, 2014

Related U.S. Application Data

(60) Provisional application No. 61/344,297, filed on Jun. 24, 2010.

(30) Foreign Application Priority Data

Jun. 24, 2010 (EP) ..... 10167173

(51) Int. Cl.
*B02C 4/30* (2006.01)

(52) U.S. Cl.
CPC ..... *B02C 4/30* (2013.01); *Y10T 29/49547* (2015.01)

(58) Field of Classification Search
CPC ..... Y10T 29/49547; Y10T 29/49549; Y10T 29/49556; Y10T 29/49558; Y10T 29/53683; Y10T 29/5383; B21B 27/02; B21B 31/02; B21B 31/22; B02C 4/30
(Continued)

(56) References Cited

U.S. PATENT DOCUMENTS 1,740,490 A 4/1928 Brasington
3,779,470 A * 12/1973 Smits ..... 241/191

FOREIGN PATENT DOCUMENTS

DE 32 11 648 A1 10/1983
EP 1 661 624 A1 5/2006
(Continued)

OTHER PUBLICATIONS

International Search Report dated Apr. 11, 2011.
International Preliminary Report on Patentability dated Jul. 12, 2012.

*Primary Examiner* — Faye Francis
*Assistant Examiner* — Onekki Jolly
(74) *Attorney, Agent, or Firm* — Andrus Intellectual Property Law, LLP

(57) ABSTRACT

A roller for a roller grinder, the roller including a shaft and a grinding shell in the form of a tubular sleeve and having an inner face to be retained around the shaft. The roller grinder is characterized in that the shaft includes two shaft parts, each shaft part having a respective inner end portion, wherein the inner end portions are arranged to be positioned facing each other and include coupling portions arranged to couple the inner end portions of the respective shaft parts to each other, thereby forming the shaft. The disclosure further relates to a method for assembling a roller for a roller grinder, the roller including a shaft and a grinding shell in the form of a tubular sleeve and having an inner face to be retained around the shaft.

15 Claims, 5 Drawing Sheets

(58) Field of Classification Search
USPC ..... 241/293; 29/895.2, 895.21, 895.22, 29/895.23, 239, 252
See application file for complete search history.

(56) References Cited

FOREIGN PATENT DOCUMENTS

| | | | | | |
|---|---|---|---|---|---|
| FR | 2498478 | A1 | | 7/1982 | |
| GB | 21776 | | | 0/1898 | |
| GB | 469343 | | | 7/1937 | |
| GB | 1502940 | | * | 6/1976 | ..... D01G 15/92 |

* cited by examiner

ROLLER FOR HIGH PRESSURE ROLLER GRINDER, ROLLER GRINDER, AND METHOD FOR ASSEMBLING A ROLLER FOR A ROLLER GRINDER

CROSS-REFERENCE TO RELATED APPLICATIONS

This application claims priority to PCT/IB2011/052568, filed Jun. 24, 2011, and published in English on Dec. 29, 2011 as publication number WO 2011/161583, which claims priority to EP Application No. 10167173.3, filed Jun. 24, 2010, and U.S. Provisional Application No. 61/344,297, filed Jun. 24, 2010, incorporated herein by reference.

TECHNICAL FIELD OF THE INVENTION

The present invention relates to a roller for a roller grinder, the roller comprising a shaft and a grinding shell in the form of a generally tubular sleeve and having an inner face to be retained around the shaft. The invention further relates to a roller grinder and a method for assembling a roller for a roller grinder.

BACKGROUND ART

High pressure roller grinders for grinding rock and the like are for obvious reasons subjected to a high level of wear from the processed material. Each roll of a roller grinder therefore commonly utilizes an outer cylindrical grinder shell made of a wear resistant material covering the rolls. The grinder shell eventually has to be replaced when worn down by the processed material, causing an interruption of the operation of the equipment.

The grinding or crushing shell has to be tightly mounted around the hub portion of the shaft, with a high friction between the parts to avoid loosening of the shell during operation of the grinder. The hub portion of the shaft may have a cylindrical shape or may be slightly conical to enable easy mounting and dismounting of the grinder shell. The conicity is preferably minimal, to prevent the grinding shell from being undesirably released during operation of the grinder.

In a known constructive solution, the outer grinding shell is designed to be mounted around the hub portion of the shaft by means of thermal expansion-contraction. The outer grinding shell is heated to present a thermal expansion sufficient to allow it to axially slide around the shaft, until reaching the mounting position, in which its cooling and shrinkage produce its retention, by high interference, around the hub portion of the shaft, the hub portion being generally cylindrical.

This known mounting solution presents some inconveniences. The outer grinding shell can crack upon cooling, particularly when it is made of a hard high carbon steel, and it can lose its uniformity and its cylindrical tubular geometric form, due to the stress caused by application of heat. The mounting solution by thermal expansion-contraction of the outer grinding shell also presents inconveniences when dismounting the grinding shell from the hub portion of the shaft. The dismounting is extremely difficult due to the high level of frictional interference between the two parts. This difficulty is so great and time consuming that it is frequently preferred to replace the whole shaft-grinding shell assembly, undesirably increasing the costs of replacing the already worn out grinding shells. This problem is particularly cost inducing when the frequency of these replacements is high due to a high level of wear of the outer shell. It is also frequent, in such cases, that the shaft is damaged during the dismounting procedure, further increasing the replacement costs of the grinding shell. In many cases, the bearings, which are usually an expensive part, are integrated in the shaft assembly, further increasing the cost of the replacement when not being able to dismount the outer shell.

There are also known mounting solutions which utilize an internally conical grinding shell operating around a wedge provided between the hub portion of the shaft and the grinding shell and which is forced towards the central region of the roller, producing inward and outward radial forces against the shaft and against the grinding shell, respectively, producing the necessary high level of frictional interference between the grinding shell and the shaft. Although overcoming the inconveniences related to the mounting by thermal expansion-contraction, the utilization of a wedge and an internally conical grinding shell presents the inconvenience of making the axial and radial alignments difficult and the replacement operations of the grinding shell complex and costly.

U.S. Pat. No. 5,060,874 describes a mounting solution according to which each shaft medianly carries a pair of externally conical hubs, each being operatively associated with shrink discs, wedges and an expansion ring, to establish a high level of frictional interference between the grinding shell and the shaft, without requiring thermal expansion-contraction of the recipient. This prior solution requires a large number of components, which undesirably raises its cost.

SUMMARY OF THE INVENTION

It is an object of the present invention to solve, fully or partially, the above problems and to provide an improved roller for a roller grinder having an outer grinding shell that is easy to mount and dismount, so as to reduce costs when exchanging worn down grinder shells, while still providing a grinding shell that does not loosen during operation of the grinder.

These and other objects are achieved by a roller for a roller grinder, said roller comprising a shaft and a generally cylindrical grinding shell having an inner face to be retained around the shaft. The roller is characterized in that the shaft comprises two shaft parts, wherein said shaft parts comprise coupling portions arranged to couple the shaft parts to each other, thereby forming the shaft.

By splitting the shaft in two parts, compared to the prior art, the grinder shell in the form of a tubular sleeve can easily be dismounted after being worn down by usage of the grinding equipment. One of the shaft parts is simply dismounted by releasing the coupling portion, to allow the grinding shell to be pulled off the roller shaft for being exchanged with a new grinding shell.

In an embodiment, the grinding shell is in the form of a generally tubular sleeve.

According to an embodiment, it is preferred that each shaft part has a respective inner end portion, wherein said inner end portions are arranged to be positioned facing each other and to be coupled to each other by said coupling portion.

In one embodiment, each shaft part may have a respective inner end portion, wherein said inner end portions are arranged to be positioned facing each other at a respective end portion of said roller and to be coupled to said respective end portion of said roller. In this manner, the shaft parts need not reach all the way through the grinding shell and the shaft parts may be coupled to each other indirectly, via the grinding shell, thereby forming the shaft.

It is further preferred that the coupling portions are arranged to axially force the shaft parts towards each other.

It is further preferred that each shaft part comprises a respective hub element against which an inner surface of the grinding shell is to be seated. The shape of the hub elements is preferably corresponding to the inner surface of the grinding shell to ensure high frictional interference between the two parts, so that the grinding shell will not move in any direction relative to the shaft.

It is further preferred that each hub element has a frusto-conical shape and that the inner surface of the grinding shell has two inner surface portions, each having a frusto-conical shape corresponding to the frusto-conical shape of the respective hub elements, the inner surface portions of the grinding shell being arranged with a smaller base of the respective frusto-conical shape facing each other and a larger base of the respective frusto-conical shape facing away from each other.

By using this double frusto-conical geometry of the parts the grip of the grinding shell on the shaft is ensured. When mounting the grinding shell, the shell is axially mounted onto the first part of the dismounted shaft until the conical shape of the inner part of the shaft and of the grinding shell stop further axial movement. The second part of the shaft is then mounted by pushing the part axially into the shell until the conical shape of the second shaft part and of the grinding shell stop the movement. The outer sides of the shaft parts are then in abutment with the inner sides of the grinder shell over their entire surfaces, respectively, causing a large frictional force between the parts. The double conical geometry of the fastening mechanism of the grinding shell can use much larger angles than the slightly single conical shapes of the prior art. In the prior art, a large angle of the single conical shape could risk that the grinding shell would loosen during operation of the roller grinder. Using the here presented double conical shape, any angle of the cone could be used. A practically useful angle could be, e.g., 2 to 5 degrees, making both the assembling and dissembling process convenient.

It is further preferred that the larger base of the respective frusto-conical shape of the inner surface portions of the grinding shell is arranged at a respective axially outer end of the grinding shell. It is advantageous that the frusto-conical shape of the shaft parts end outside the surrounding grinding shell so that the shaft parts do not jam inside the grinding shell when dismounting the shaft parts and the grinding shell.

It is further preferred that the smaller base of the respective frusto-conical shape of the inner surface portions of the grinding shell coincide so that no edges are created against which the shaft parts can be pressed if the shell is not perfectly aligned. It is also easier in the manufacturing process to make the two inner sides of the outer shell having the same conical shape and angle. The mounting is also simplified since the grinding shell then is symmetrical and can be put onto the shaft from either side with respect to its longitudinal axis. Another advantage is that the grinding shell can be dismounted and turned 180 degrees if the shell is worn unsymmetrically during operation of the roller grinder.

It is further preferred that the coupling portions are arranged to axially force the hub elements towards each other, thereby pressing the hub elements against the inner surface of the grinding shell and retaining the grinding shell on the shaft.

As the axial force pressing the shaft parts towards each other is increased, the frusto-conical shapes of the parts, as described above, will lead to an increased frictional interference between the grinding shell and the shaft. The friction force between the shaft and the grinding shell can thus be adjusted to be high enough to ensure that the grinding shell does not loosen or move relative to the shaft parts during operation, but low enough to not crack the grinding shell from the material tension between the parts.

It is further preferred that the coupling portions of at least one of the shaft parts comprises mechanical, pneumatic, hydraulic or magnetic coupling means. What coupling means are chosen to provide the axial force pressing the shaft parts together is dependent on the magnitude of the force needed, what is practical and what is achievable at a reasonable cost. It is preferred that the coupling portions of at least one of the shaft parts comprises a gripping device longitudinally disposed through the respective shaft part, having an actuation end portion, external to the shaft, and an engaging end portion, projecting from the respective inner end portion and to be engaged in the other respective shaft part.

In one embodiment, the coupling portions of at least one of the shaft parts may comprise a gripping device longitudinally disposed through the respective shaft part, having an actuation end portion, external to the shaft, and an engaging portion, projecting from the respective inner end portion and to be engaged in said grinding shell. Thereby, the shaft parts may be securely fastened in the grinding shell.

According to a further embodiment the roller grinder roller further comprises an extracting device arranged to force the shaft parts axially away from each other for disassembling the shaft, since the dismounting of the shaft parts may be difficult after long and intensive use of the roller grinder. It is preferred that the extracting device comprises a chamber, defined between the inner end portions of said shaft parts, and a duct disposed through at least one of the shaft parts and having an end open to the chamber and another end open to the exterior of the respective shaft part arranged to be connected to a pressure source, so as to allow the selective pressurization of the chamber to force the shaft parts away from each other in opposite axial directions. When dismounting the shaft parts the chamber is pressurized and the parts will be forced away from one another and thus dismounted.

In another embodiment, the extracting device may comprise a jack arrangement arranged to force the shaft parts away from each other in opposite axial directions. The jack arrangement may induce the forces necessary to remove the shaft parts from the grinding shell. Additionally, the jack arrangement may be arranged to force the shaft parts towards each other. A particularly secure connection of the shaft parts and the grinding shell may thereby be achieved.

It is further preferred that one of the inner end portions of the shaft parts comprises a guide portion, the other hub element comprising a guide receiving portion in which the guide portion is arranged to be coupled, when the shaft parts are coupled to each other, thereby keeping the two shaft parts axially aligned with one another. If an axial alignment is not ensured, the grinding shell will wobble and invoke unnecessary and uneven wear of the wear resistant layer of the grinding shell.

It is further preferred that the guide portion comprises at least one end axial projection of the respective inner end portion, the guide receiving portion comprising an end axial recess provided in the other inner end portion and which is dimensioned to slidably receive and axially guide the respective end axial projection, when said shaft parts are coupled with each other.

It is a further object of the present invention to provide a method for assembling a roller for a roller grinder, said roller comprising a shaft and a generally cylindrical grinding shell having an inner face to be retained around the shaft, said shaft further comprising two shaft parts. The method comprises the steps of: mounting the grinding shell onto the first shaft part, pushing the second shaft portion into the grinding shell towards the first shaft portion, releasably coupling the parts to each other using coupling portions, the two shaft parts thereby forming the shaft. The invention thus provides a convenient and fast method to assemble and disassemble a roller for a roller grinder by using the inventive roller described above, having a shaft comprising two parts coupled through a tubular grinding shell. The method is advantageous when exchanging a worn down grinding shell of a roller of a roller grinder.

It should be noted that the inventive method may incorporate any of the features described above in association with the inventive roller for a roller grinder, and has the same corresponding advantages. In a particular variant of the method, the shaft parts are coupled to each other via the grinding shell.

BRIEF DESCRIPTION OF THE DRAWINGS

In the following, embodiments will be described in closer detail, by way of non-limiting examples. In the drawings

DETAILED DESCRIPTION OF PREFERRED EMBODIMENTS OF THE INVENTION

Figure 1:
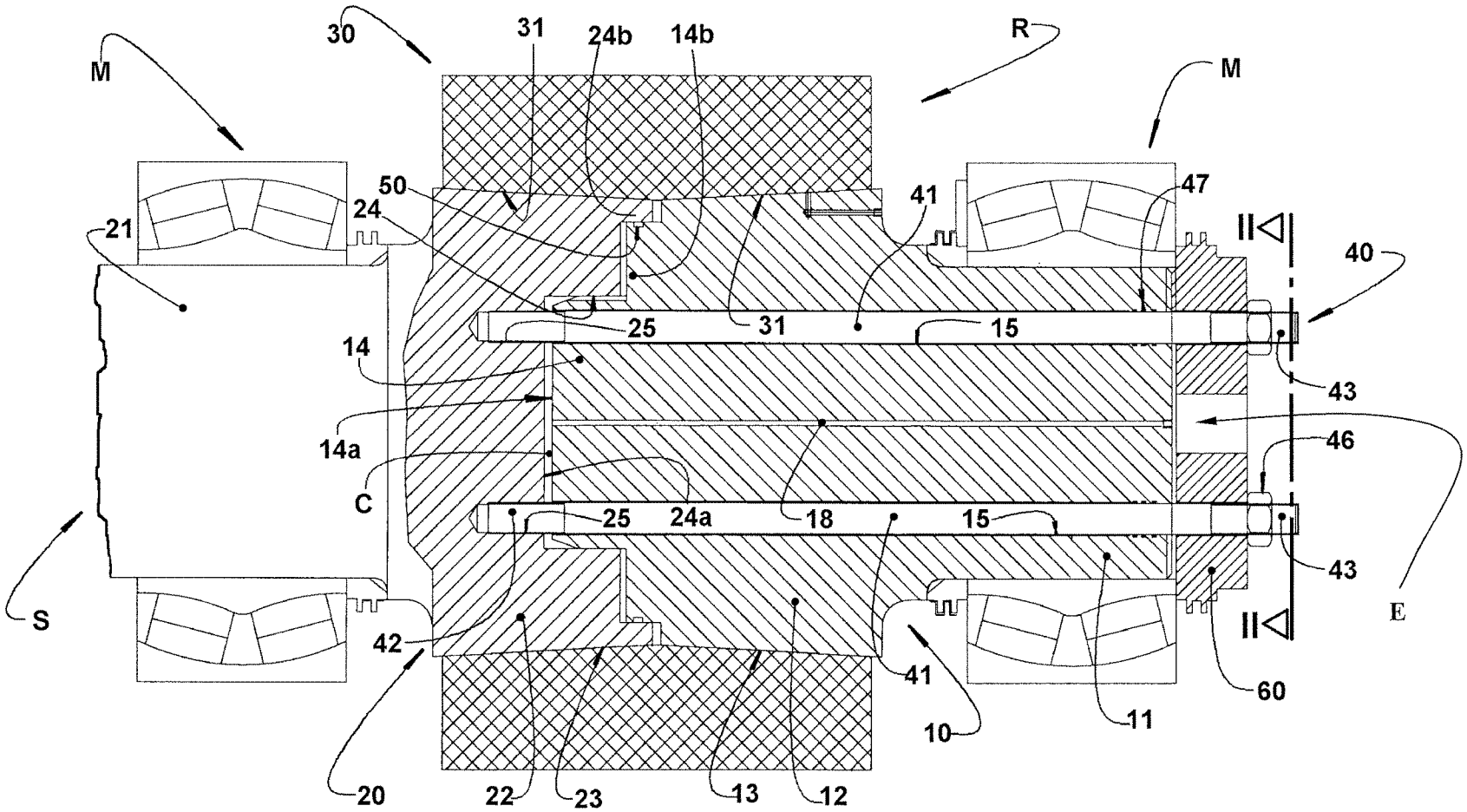
FIG. 1 shows a cross sectional lateral view of a roller grinder according to an embodiment of the present invention illustrating the two shaft parts in a mounting condition in the interior of the grinding shell in the form of a tubular sleeve.

FIG. 1 shows one of the rolls R in a preferred embodiment of a roller grinder (not fully shown) according to the present invention. Each roller R comprises a shaft S, the shaft S being held in the roller grinder by the two bearings M. The shaft S is constructed by a first shaft part 20 and a second shaft part 10, each comprising a respective end portion 21, 11 of the shaft S and a respective hub element 22, 12 which, in this preferred, but not limiting, embodiment, comprises frusto-conical portions 23, 13.

The hub element 12 of the second shaft portion 10 has a guide means 14 to be coupled to a guide receiving means 24 provided in the other hub element 22 of the first shaft portion 20 in order to keep the shaft parts 10, 20 axially aligned with one another.

Each frusto-conical portion 13, 23 presents its larger base turned to their respective axial end portions 11, 21 of the shaft S and a smaller base turned to the other shaft part 10, 20. The area of the larger base, but also the area of the smaller base of the frusto-conical portions 13, 23 are larger than the area enclosed by the area of the end portions 11, 21 of the shaft S. The angle of the conical shape of the frusto-conical portions 13, 23 can vary from project to project, but are generally kept between about 2 and about 5 degrees in relation to the shaft of the assembly.

The guide means 14, carried by one of the hub elements 12, comprises at least one end axial projection 14*a*, with a substantially cylindrical cross section that is smaller than the cross section of the adjacent smaller base of the respective frusto-conical portion 13. The guide receiving means 24 of the other hub element 22 comprises an end axial recess 24*a* having a cross section similar to that of the end axial projection 14*a*, i.e., generally cylindrical, dimensioned to slidably receive and axially guide the respective end axial projection 14*a* of the hub element 12, when said hub elements 12, 22 are axially forced towards each other. In FIG. 1, the guide means 14 is in its end position inside the recess 24*a* of the receiving means 24.

As illustrated in FIG. 1, the two shaft parts 10, 20 are axially forced towards each other by coupling portions 40, for coupling the guide means 14 to the guide receiving means 24. In FIG. 1, the coupling portions are mechanical gripping devices 40 longitudinally disposed through the shaft part 10, having an actuation end portion 43, external to the shaft S, and an engaging end portion 42, projecting from the hub element 12 into the hub element 22 engaging the shaft part 20.

In FIG. 1, the gripping means 40 are defined by a plurality of bolts 41 lodged in respective longitudinal through holes 15 provided in the shaft parts 10. Each bolt 41 has an engaging threaded end portion 42 engaged in a longitudinal threaded hole 25 of the other shaft part 20. An actuation end portion 43, opposite to the engaging end portion 42, projects outwardly from the end portion 11 of the shaft part 10 and is also threaded, configured to be engaged to a drawing device 46, illustrated in FIG. 1 as a nut.

Figure 2:
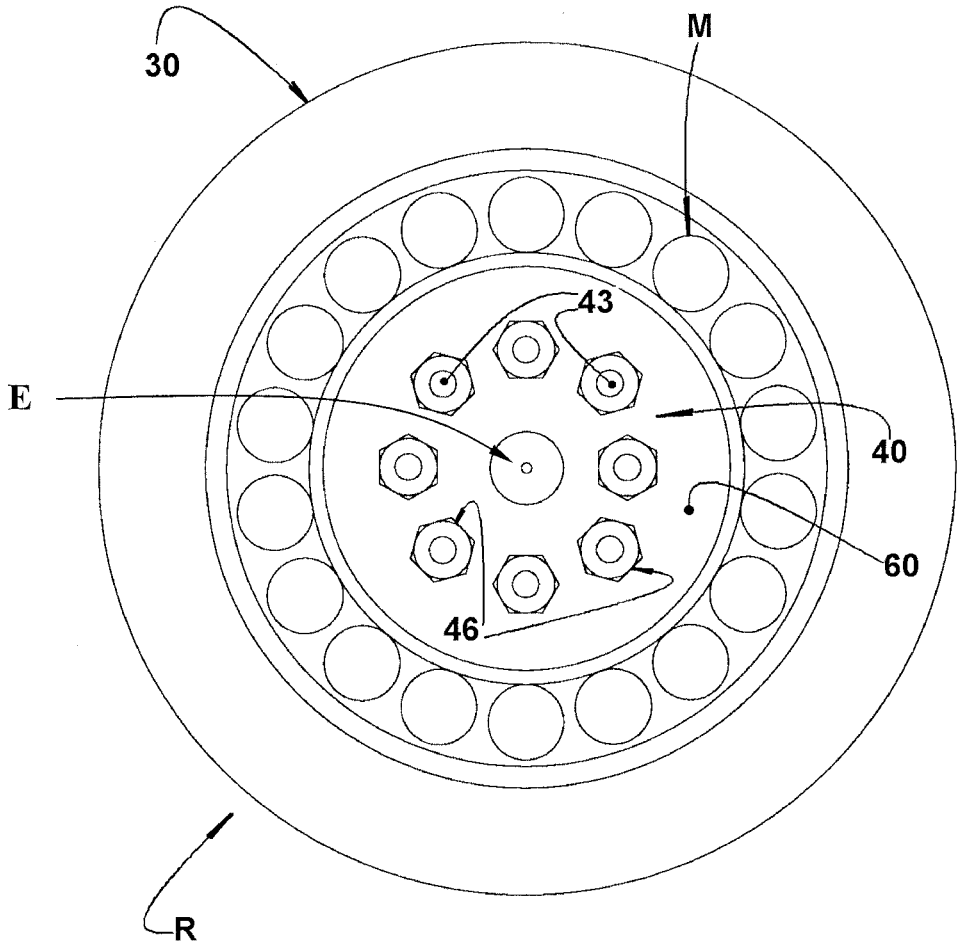
FIG. 2 shows an end view of the roller constructed according to the present invention, taken according to line II-II in FIG. 1.

As can be seen in FIG. 2, the bolts 41 are evenly distributed through the two shaft parts 10, 20, preferably in a circular arrangement, angularly spaced from each other so that the controlled gripping of the drawing devices 46, in the form of nuts, produces the axial displacement of the two shaft parts 10, 20 towards each other in the axial direction of the shaft.

Again with reference to FIG. 1, the grinding shell 30 has the form of a tubular sleeve constructed by a hard material adequate to the grinding or crushing work. The grinder shell 30 inner face has two frusto-conical surfaces 31, each cone having its larger base turned towards the respective end of the grinder shell 30. The smaller base of the frusto-conical surfaces 31 are directed towards the middle of the grinder shell, facing each other, and in FIG. 1 coinciding with each other, resembling an hourglass shape. The bolts 41 of the mechanical gripping device 40 will axially force the two shaft parts 10, 20 towards each other, forcing the frusto-conical portions 13, 23 to be seated against the respective inner surfaces of the grinding shell 31. Tightening of the gripping device 40 drawing devices 46 will gradually increase the radial pressure of the shaft parts against the respective frusto-conical inner surfaces 31 of the grinding shell 30, inducing an increasing frictional force between the grinding shell and the shaft parts 10, 20 preventing movement of the grinding shell relative to the shaft parts. The bolts 41 of the gripping device 40 is dimensioned to produce a degree of frictional interference between the frusto-conical portions 13, 23 and the grinding shell 30 sufficient to lock the latter around the shaft S during all grinding and grinding operations within the specifications of the roller grinder.

The roller R may be provided with an extracting means E to axially force said shaft parts in opposite directions, spacing the respective hub elements 12, 22 apart from each other and from the inner face 31 of the grinding shell 30 when dismounting the grinding shell 30 from the shaft parts 10, 20. With reference to FIG. 1, the extracting means E comprises a chamber C defined between the two hub elements 12, 22 and a duct 18 disposed through the shaft 10 having an opening to the exterior of the shaft part 10, so as to allow the selective pressurization of the chamber C through the duct 18.

In FIG. 1, the end axial recess 24*a* of the guide receiving means 24 presents an axial extension larger than that of the respective end axial projection 14*a* of the guide means 14, so as to define the chamber C between the free end of said end axial projection 14*a* and the interior of the end axial recess 24*a*. The duct 18 allows the chamber C to be selectively pressurized to force the shaft parts 10, 20 in opposite axial directions away from their seated condition against the inner surface portions 31 of the grinding shell 30, for a replacement operation of the latter. The pressurization of the chamber C has the object of helping the axial displacement for releasing the two shaft parts 10, 20. The importance of this pressurization is greater the smaller the conicity of the frusto-conical portions 13, 23 and 31.

To ensure a better sealing of the chamber C, sealing means 50 in the form of an O-ring in anti-friction metallic or elastomeric material is provided around the base portion 14*b*, actuating against the enlargement 24*b* of the end axial recess 24*a*. In this case, the annular sealing means 50 is mounted between the base portion 14*b* and the enlargement 24*b*.

Figure 1A:
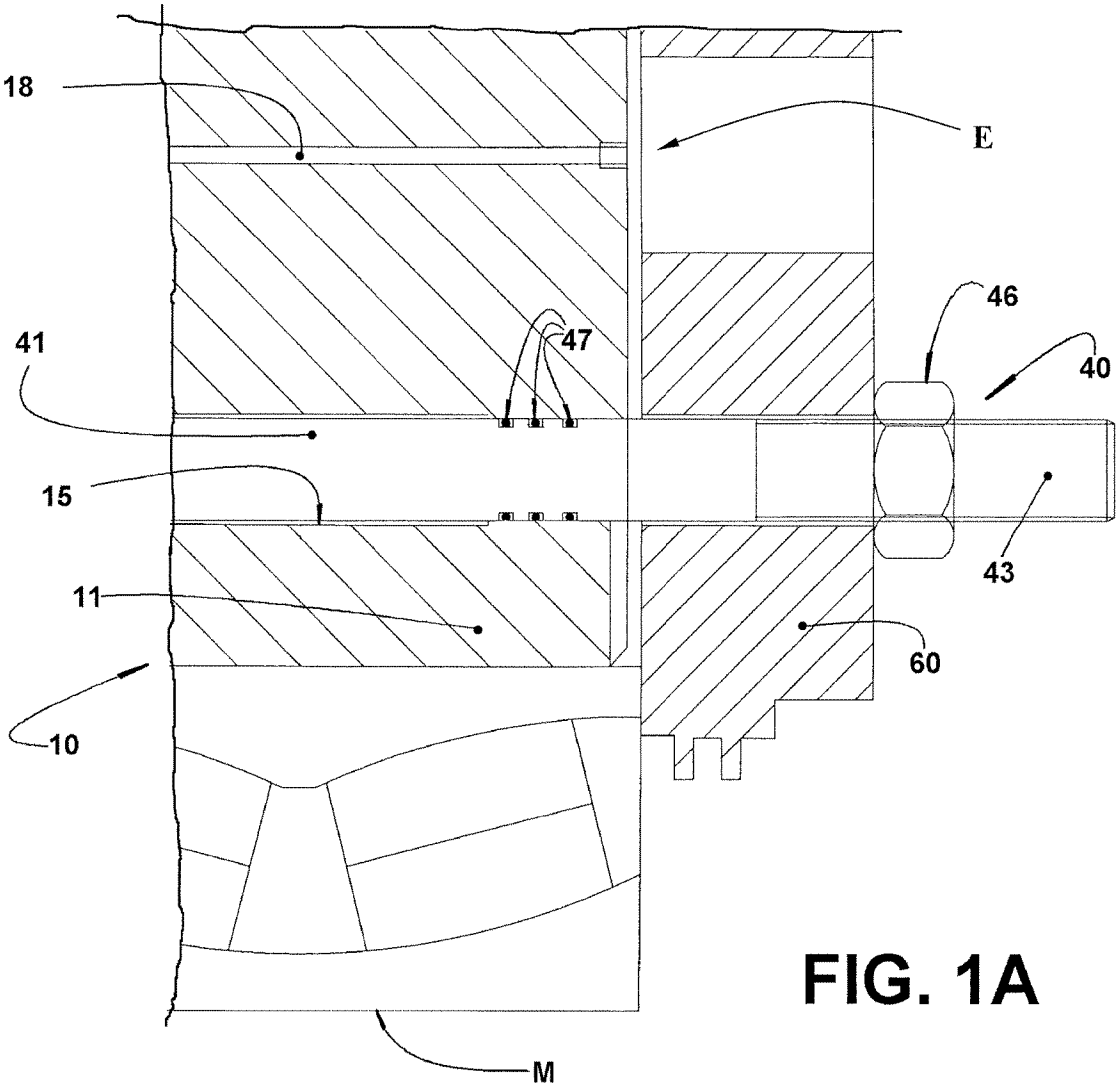
FIG. 1A shows an enlarged detail of FIG. 1, illustrating the sealing region between a gripping means and the respective shaft part that carries it.

Considering that the bolts 41 can be provided through the chamber C, it is preferred that they be also disposed through sealing rings 47 lodged in the interior of the longitudinal through holes 15, so as to obtain a higher tightness to the annular gap defined between each bolt 41 and the opposite wall of the respective longitudinal through hole 15, as illustrated in FIG. 1A. In the illustrated construction, the second shaft part 10, i.e. the part that is not coupled to a motor unit (not shown), has at its end a plate 60, which can operate as an outer axial stop for the bearing M and which, in the embodiment of FIG. 1, is fastened to the adjacent shaft part 10 by means of the bolts 41.

The exchange of a grinding shell will now be described with reference to the drawings, FIG. 1 to FIG. 3. Starting from a roller R fully assembled with the grinding shell 30 tightly mounted to the two frusto-conical shaft parts 10, 20, the frictional force, as described above, being induced by the force applied by the bolts 41 and nuts 46, pressing the shaft parts 10 towards the shaft part 20 applying a radial pressure onto the frusto-conical inner surfaces 31 of the grinding shell 30. Assuming that the grinding shell 30 has been worn out by normal operation of the roller grinder and has to be replaced, the shell will have to be replaced to ensure good grinding quality and to not risk damaging the roller grinder shaft.

The disassembling is initiated by loosening and removing the nuts 46. The end plate 60, and optionally also the bearing M holding the shaft part 10, is/are removed. The bolts 41 are also removed by unscrewing them from the threaded hole 25 in the shaft part 20 to avoid damage to the bolts during the dismounting of the shaft part 10. The shaft part 10 is now free to be dismounted. It is, however, likely that the shaft part is still hard to remove axially due to frictional forces from the grinding shell 30 inner surfaces 31. The extraction means E is then useful to assist in the dismounting process. A pressurized fluid source (not shown) is connected to the duct 18 in the second shaft part 10, applying a pressure to the chamber C between the shaft parts 10, 20. The pressurization of the camber C will force the second shaft part 10 to move away from the first shaft part 20. The grinding shell 30 is then free to be removed and exchanged with a new one.

The reassembling of the roller R is then naturally performed in the reverse manner compared to the disassembling process just described. The new grinding shell 30 is put onto the first shaft part 20 as far as the conical shapes of the shaft and the inner surface 31 of the grinding shell 30 allow. The second shaft part 10 is then put in place and pushed towards the first shaft part 20. The guide means 14 guide the second shaft part 10 into the axially aligned position by sliding into the receiving means 24 of the first shaft part 20. The bolts 41 are screwed back into the threading 25 of the first shaft part 20 and the bearing M, if dismounted from the second shaft part 10, is put back in place. The end plate 60 is slid onto the end parts of the bolts 41 and the assembly is properly tightened by tightening the nuts 46, to apply the correct radial pressure to the new grinding shell 30 from the shaft parts 10, 20, so that the grinding shell 30 will not move relative to the shaft parts 20, 21 during operation of the roller grinder.

The skilled person realizes that the present invention by no means is limited to the preferred embodiments described above. On the contrary, many modifications and variations are possible within the scope of the appended claims.

For instance, the conical shape of the shaft parts 10, 20 corresponding to the inner shape of the grinding shell 30, can be made in different ways. The frusto-conical parts 13, 23 of the shaft parts 10, 20 could have structures integrated along the radial direction such as, e.g., wedges, the grinding shell inner surfaces 31 then naturally having corresponding recesses. The shaft parts could also have cog-shaped structures along the radial direction of the frusto-conical parts 13, 23 of the shaft parts 10, 20.

The coupling portions 40 that are forcing the shaft parts 10, 20 towards each other are in the described embodiment mechanical in the form of a gripping device 40 with bolts 41 and nuts 46. It should, however, be understood that the coupling device could also be pneumatic, hydraulic, magnetic, or any other form that is capable of forcing the two shaft parts 10, 20 together.

The mechanical gripping device 40 could, e.g., be arranged in other ways. A protruding part of the shaft part 20 could, e.g., be arranged through the shaft part 10 having threads on the part that completely penetrates the shaft part 10 for fastening of a nut. The nut would then force the parts together in the same manner as in the embodiment of FIG. 1.

Figure 3:
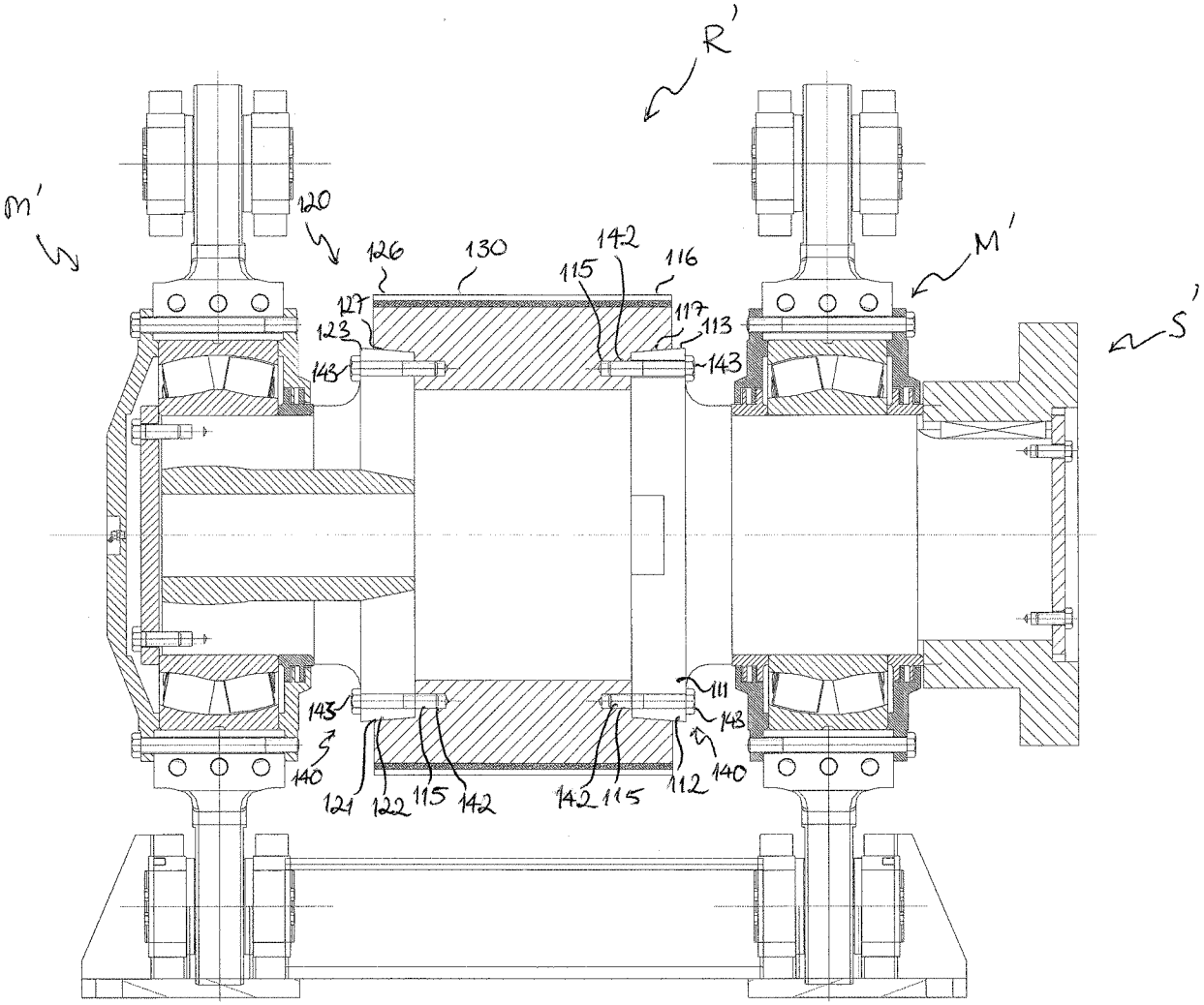
FIG. 3 shows a cross sectional lateral view of a roller grinder according to another embodiment of the present invention.

An alternative embodiment of the grinder roller of the invention may be seen in FIG. 3. In this embodiment, details corresponding to the ones in the embodiment of FIG. 1 have been given the same reference numerals, but with the addition of 100. For the details indicated by reference letters, corresponding details in the embodiment of FIG. 3 are denoted by the same letter followed by a prime sign.

As with the roller grinder R of FIG. 1, the roller grinder R' of FIG. 3 has a shaft S' made up of two shaft parts 110, 120. The shaft S' carries a grinder shell 130. In contrast to the previously described embodiment, the first shaft part 120 and the second shaft part 110 do not reach all the way through the grinder shell 130 to be coupled directly to each other. Instead, an inner end portion 121 of the first shaft part

120 engages a first end portion 126 of the grinding shell 130 and an inner end portion 111 of the second shaft part 110 engages a second end portion 116 of the grinder shell 130. In this manner, the shaft parts 110, 120 are coupled to each other indirectly, via the grinding shell 130, thereby forming the shaft S' of the grinder roller R'. Hence, in this embodiment, the shaft S' is not a single, continuous shaft. The shaft parts 110, 120 are coupled to the end portions 116, 126 of the grinding shell 130 by means of coupling portions 140 in the form of bolts with an inner engaging end portion 142 and an outer actuation end portion 143. The inner engaging end portion 142 of the respective bolt 140 is threaded into a corresponding hole 115 in the grinder shell 130. By tightening the bolts 140 the shaft portions 110, 120 are forced towards each other and into firm abutment against a frusto-conical inner surface portion 131 of a respective recess 117, 127 at the end portions 116, 126 of the grinding shell 130.

Figure 4:
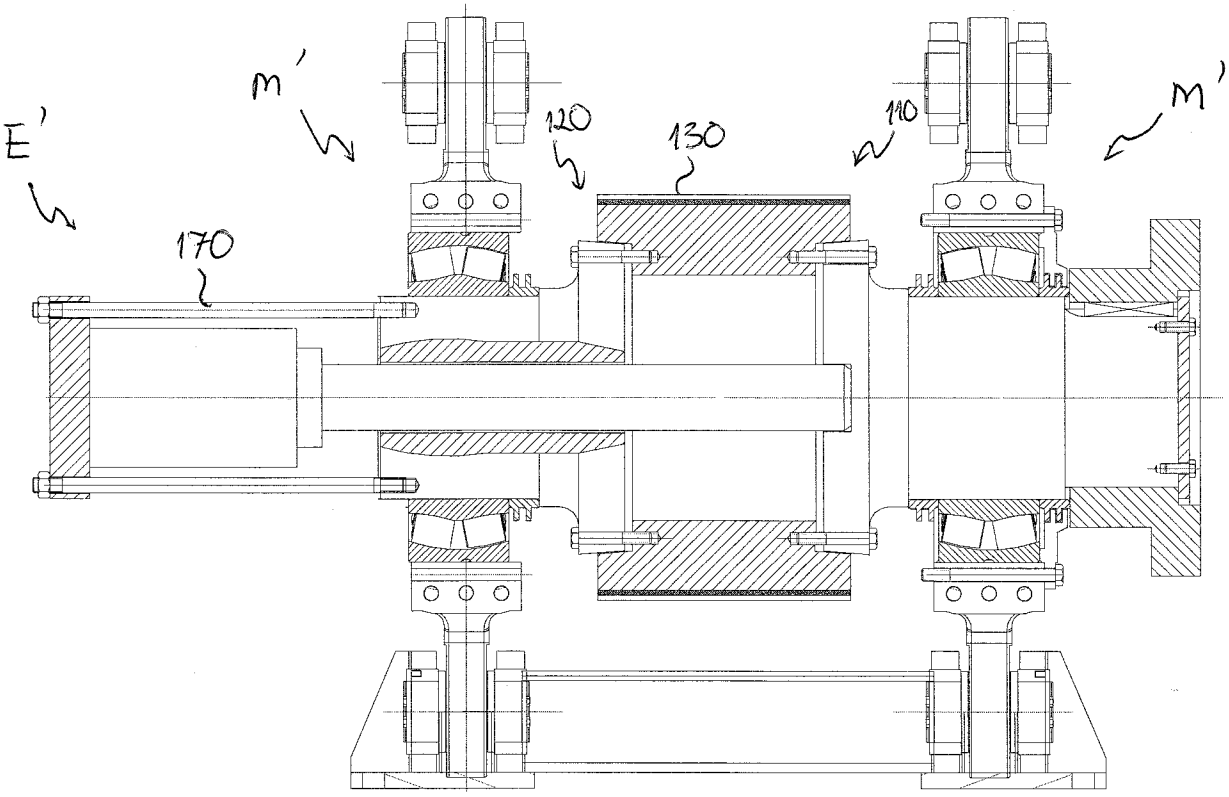
FIG. 4 shows the roller grinder of FIG. 3 during disassembling.

When the grinding shell 130 has been worn by grinding work, it may be replaced. The bolts 140 are screwed out of the holes 115 in the grinding shell 130 and an extraction device E' in the form of a jack arrangement 170 is used for forcing the shaft parts 110, 120 away from each other. As may been seen in FIG. 4, the inner end portions 111, 121 of the shaft parts 110, 120 are retracted out of the recesses 117, 127 in the end portions 116, 126 of the grinding shell 130. The jack arrangement 170 moves the bearing M' on the left-hand side of the drawing with the first shaft part 120 away from the second shaft part 110, thereby completely releasing the grinding shell 130. The worn grinding shell 130 may now be removed and replaced by a new grinding shell. The worn grinding shell 130 may be discarded or, alternatively, renovated and provided with a new wear-resistant grinding surface.

The jack arrangement 170 may also be used to force the shaft parts 110, 120 towards each other. Thus, an additional force holding the shaft parts 110, 120 and the grinding shell 130 together is provided.

In the embodiment shown in FIG. 3, the grinding shell 130 is a hollow cylinder or sleeve. However, the grinding shell could also be a more or less solid cylinder, with the recesses 117, 127 only extending a short axial distance from the respective end portion 116, 126 into the grinding shell 130. Naturally, the length of the recesses may be adapted to any shape and dimensions of the inner end portions of the shaft parts.

Variants corresponding to a hybrid between the grinding shell 130 of FIG. 1 and the grinding shell 130' of FIG. 3 could also be possible, wherein portions of the shaft parts resembling the inner end portions 111, 121 of the shaft parts 110, 120 of FIG. 3 are fastened in recesses resembling the recesses 117, 127 in FIG. 3 and wherein a shaft portion of smaller diameter of each shaft part extends further into the grinding shell, such that the inner ends of these smaller diameter shaft portions may be coupled to each other in a manner resembling the coupling in FIG. 1.

According to one aspect, the invention could be defined in accordance with the following clauses.

1. A roller for a roller grinder, said roller comprising a shaft and a generally cylindrical grinding shell being supported by said shaft, wherein said grinder shell at each axial end has a recess and wherein said shaft comprises two shaft parts, each shaft part having a respective inner end portion, each inner end portion being arranged to be positioned in a respective recess of said grinder shell and said shaft parts have coupling portions arranged to couple said shaft parts to said grinding shell, thereby forming the shaft.

2. A roller as defined in clause 1, wherein the grinding shell is a generally tubular sleeve.

3. A roller as defined in clause 1, wherein the grinding shell is a generally solid cylinder, said recesses reaching only part-way along the axial length of said grinding shell.

4. A roller as defined in any one of the preceding clauses, wherein each shaft part comprises a hub element against which an inner surface of said recess is to be seated.

5. A roller as defined in clause 4, wherein each recess of said grinding shell has an inner surface portion having a frusto-conical shape corresponding to a frusto-conical shape of said hub elements, the inner surface portions of said recesses being arranged with a smaller base of the respective frusto-conical shape facing each other and a larger base of the respective frusto-conical shape facing away from each other.

6. A roller as defined in clause 5, wherein the larger base of the frusto-conical shape of the inner surface portions is arranged at the respective axial end of said grinding shell.

7. A roller as defined in any one of clauses 4-6, wherein the coupling portions may be arranged to axially force the hub elements towards each other, thereby pressing the hub elements against the inner surface of the recesses and retaining the grinding shell on the shaft formed by the two shaft parts.

8. A roller as defined in any one of the preceding clauses, wherein the coupling portion of at least one of the shaft parts comprises mechanical, pneumatic, hydraulic or magnetic coupling means.

9. A roller as defined in any one of the preceding clauses, wherein the coupling portion of at least one shaft part comprises bolts lodged in respective through holes provided in said at least one shaft part, each bolt having an engaging end portion defined by an end to be engaged in the grinding shell, and an actuation end portion defined by an opposite end, projecting outwardly from an end portion of said at least one shaft part.

10. A roller as defined in any one of the preceding clauses, further comprising an extracting device arranged to force the shaft parts axially away from each other for disassembling the shaft.

11. A roller as defined in clause 10, wherein said extracting device comprises a jack arrangement arranged to force the shaft parts away from each other in opposite axial directions.

12. A roller grinder for grinding materials such as minerals, comprising a roller as defined in any one of the preceding clauses.

13. A method for assembling a roller for a roller grinder comprising a shaft and a generally cylindrical grinding shell, wherein said grinder shell at each axial end has a recess and wherein said shaft comprises two shaft parts, said method comprising the steps of:

engaging one of said shaft parts in one of said recesses, pushing the other shaft part into the other recess, releasably coupling said shaft parts to said grinding shell using coupling portions, the two shaft parts thereby forming the shaft.

14. A method as defined in clause 13, further comprising the axially forcing shaft parts towards each other and into said recesses using said coupling portions.

15. A method as defined in clause 14, further comprising the step of:

axially forcing the shaft parts towards each other until inner surface portions with a frusto-conical shape of said recesses are seated against corresponding frusto-conical portions of said shaft parts, the inner surface portions of said recesses being arranged with a smaller base of the respective frusto-conical shape facing each other and a larger base of the respective frusto-conical shape facing away from each other.

The invention claimed is:

1. A roller for a roller grinder, said roller comprising a shaft and a cylindrical grinding shell having an inner face to be retained around the shaft, wherein the shaft comprises two shaft parts, wherein said shaft parts comprise coupling portions arranged to couple the shaft parts to each other, thereby forming the shaft, wherein each shaft part has a respective inner end portion, wherein said inner end portions are arranged to be positioned facing each other and to be coupled to each other by said coupling portions wherein each shaft part comprises a respective hub element against which an inner surface of the grinding shell is to be seated, and wherein each hub element has a frusto-conical shape and wherein the inner surface of the grinding shell has two inner surface portions, each inner surface portion having a frusto-conical shape corresponding to a frusto-conical shape of the respective hub elements, the inner surface portions of the grinding shell being arranged with a smaller base of the respective frusto-conical shape facing each other and a larger base of the respective frusto-conical shape facing away from each other.

2. The roller as claimed in claim 1, wherein said grinding shell is in the form of a tubular sleeve.

3. The roller of claim 1, wherein the coupling portions are arranged to axially force the shaft parts towards each other.

4. The roller of claim 1, wherein the larger base of the respective frusto-conical shape of the inner surface portions of the grinding shell is arranged at a respective axially outer end of the grinding shell.

5. The roller of claim 4, wherein the smaller base of the respective frusto-conical shape of the inner surface portions of the grinding shell coincide.

6. The roller of claim 5, wherein the coupling portions are arranged to axially force the hub elements towards each other, thereby pressing the hub elements against the inner surface of the grinding shell and retaining the grinding shell on the shaft.

7. The roller of claim 1, wherein the coupling portions of at least one of the shaft parts comprises mechanical, pneumatic, hydraulic or magnetic coupling means.

8. The roller of claim 1, wherein the coupling portions of at least one of the shaft parts comprises a gripping device longitudinally disposed through the respective shaft part, having an actuation end portion, external to the shaft, and an engaging end portion, projecting from the respective inner end portion and to be engaged in the other respective shaft part.

9. The roller of claim 1, further comprising an extracting device arranged to force the shaft parts axially away from each other for disassembling the shaft.

10. The roller of claim 9, wherein the extracting device comprises a chamber, defined between the inner end portions of said shaft parts and a duct disposed through at least one of the shaft parts and having an end open to the chamber and another end open to the exterior of the respective shaft part arranged to be connected to a pressure source, so as to allow the selective pressurization of the chamber to force the shaft parts away from each other in opposite axial directions.

11. The roller of claim 9, wherein the extracting device comprises a jack arrangement arranged to force the shaft parts away from each other in opposite axial directions.

12. The roller of claim 1, wherein one of the inner end portions of the shaft parts comprises a guide portion, the other hub element comprising a guide receiving portion in which the guide portion is arranged to be coupled, when the shaft parts are coupled to each other, thereby keeping the two shaft parts axially aligned with one another.

13. The roller of claim 12, wherein the guide portion comprises at least one end axial projection of the respective inner end portion, the guide receiving portion comprising an end axial recess provided in the other inner end portion and which is dimensioned to slidably receive and axially guide the respective end axial projection, when said shaft parts are coupled to each other.

14. A roller grinder for grinding materials such as minerals, comprising at least one roller including a shaft and a cylindrical grinding shell having an interface surface to be retained around the shaft, wherein the shaft comprises two shaft parts each including a coupling portion arranged to couple the shaft parts to each other to form the shaft, wherein each shaft part has a respective inner end portion, wherein the inner end portions are arranged to be positioned facing each other and to be coupled to each other by the coupling portions, wherein each shaft part comprises a respective hub element against which an inner surface of the grinding shell is to be seated, and wherein each hub element has frusto-conical shape and wherein the inner surface of the grinding shell has two inner surface portions, each inner surface portion having a frusto-conical shape corresponding to a frusto-conical shape of the respective hub elements, the inner surface portions of the grinding shell being arranged with a smaller base of the respective frusto-conical shape facing each other and a larger base of the respective frusto-conical shape facing away from each other.

15. A roller for a roller grinder, the roller comprising:

a shaft including two shaft parts, wherein the shaft parts comprise coupling portions arranged to couple the shaft parts to each other to form the shaft, wherein each shaft part has a respective inner end portion, wherein the inner end portions are arranged to be positioned facing each other and to be coupled to each other by the coupling portions;

a cylindrical grinding shell having an inner surface to be retained around the shaft; and an extracting device arranged to force the shaft parts axially away from each other for disassembling the shaft, wherein the extracting device includes a chamber formed between the inner end portions of the shaft parts and a duct disposed through at least one of the shaft parts and having a first end open to the chamber and a second end open to the exterior of the respective shaft part, the second end arranged to be connected to a pressure source to allow the selective pressurization of the chamber to force the shaft parts away from each other in opposite axial directions.

* * * * *